US005171292A

United States Patent [19]

Ortiz

[11] Patent Number: 5,171,292

[45] Date of Patent: Dec. 15, 1992

[54] LIGHT BULB AND MOUNTING ARRANGEMENT THEREFOR

[75] Inventor: Jose A. Ortiz, Paterson, N.J.

[73] Assignee: John Tirado, Paterson, N.J.

[21] Appl. No.: 769,722

[22] Filed: Oct. 2, 1991

[51] Int. Cl.[5] ..... H01R 13/00

[52] U.S. Cl. ..... 439/253

[58] Field of Search ..... 439/253-257, 439/665-667

[56] References Cited

U.S. PATENT DOCUMENTS

| | | | |
|---|---|---|---|
| 1,104,577 | 7/1914 | Thomas | 439/257 |
| 2,071,769 | 2/1937 | Schlicker et al. | 439/257 |
| 3,056,941 | 10/1962 | Eriksson | 439/256 |

FOREIGN PATENT DOCUMENTS

| | | | |
|---|---|---|---|
| 717199 | 8/1965 | Canada | 439/253 |
| 444332 | 5/1927 | Fed. Rep. of Germany | 439/253 |
| 587438 | 1/1959 | Italy | 439/253 |
| 42877 | 4/1979 | Japan | 439/257 |

*Primary Examiner*—Joseph H. McGlynn
*Attorney, Agent, or Firm*—Siegmar Silber

[57] ABSTRACT

An electric light bulb and socket system is described. The system includes a bulb with a base having a substantially cylindrical wall and a single groove extending thereinto and thereabout and also includes a socket base with an open cavity therein and retaining springs for retaining the bulb. The retaining springs are mounted within the wall of the socket base, except for the lugs of the retaining springs which extend into the socket base cavity. The lugs of the retaining springs are dimensioned to, upon the insertion of the bulb into the receptacle, protrude into the groove and to seat therewithin. As the lugs are equally spaced about the groove, the lugs exert a balanced spring pressure on the bulb to retain the bulb in the socket. With this system, the insertion of the bulb into the socket is by axial movement without orientation and without rotation thereof.

18 Claims, 3 Drawing Sheets

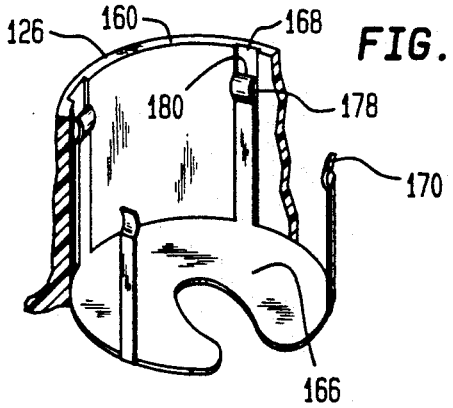
FIG. 7
FIG. 8
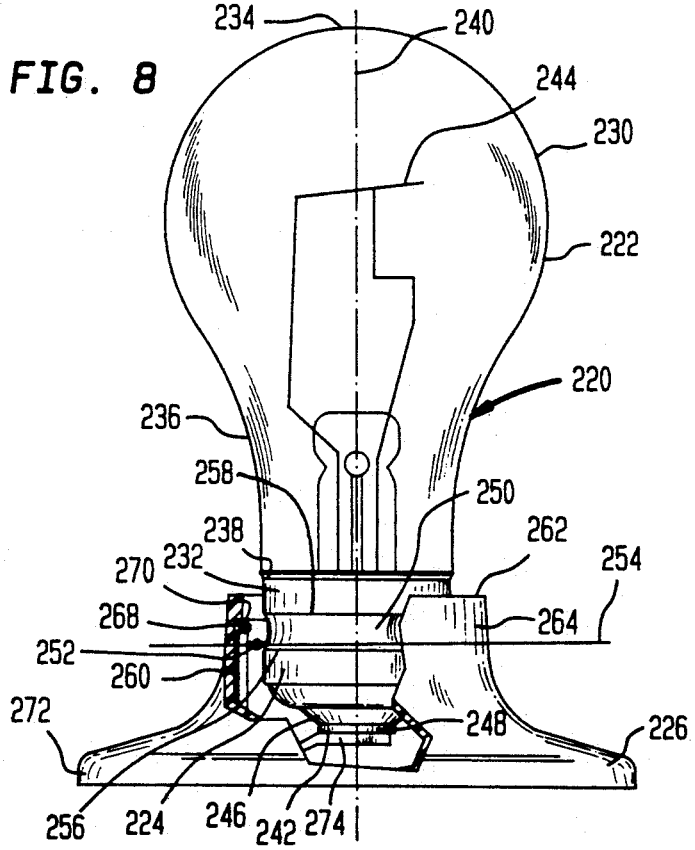
FIG. 9
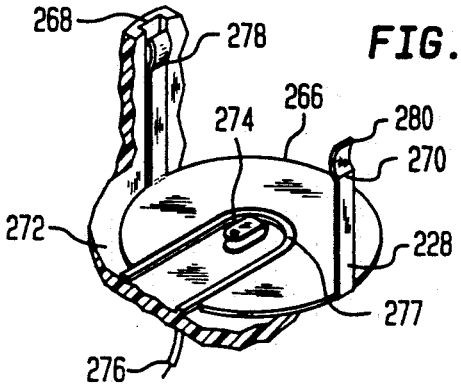

LIGHT BULB AND MOUNTING ARRANGEMENT THEREFOR

BACKGROUND OF THE INVENTION

1. Field of the Invention

This invention relates to a light bulb and a mounting arrangement therefor, and more particularly one which is readily mounted by translation along the longitudinal axis thereof.

2. Information Disclosure Statement

In preparing for this application, a pre-examination patentability search was prepared. In performing the search, the following fields and periods covered by the search were examined.

| CLASS/SUBCLASS | PERIOD COVERED |
|---|---|
| 439/616 | 11/28/1882-02/05/1991 |
| 439/619 | 01/23/1883-08/13/1991 |
| 439/611 | 03/07/1950-08/13/1991 |

Upon search, the following patents were uncovered:

| ITEM NO. | U.S. PAT. NO. | INVENTOR | ISSUE DATE |
|---|---|---|---|
| 1 | 271,171 | Edward Weston | 01/23/1883 |
| 2 | 3,215,972 | E. A. Eriksson | 11/02/1965 |
| 3 | 3,253,249 | L. J. Hess et al. | 05/24/1966 |
| 4 | 4,886,994 | Albert J. Ragge, Jr. | 12/12/1989 |

U.S. Pat. No. 271,171—E. Weston—U.S. Electric Lighting

Shows technology prior to the modern clear division between the base and socket functions. Discloses lumps of metal for contact points and springs for electrical connection. Bulb is a gravity-held, cup-supported structure.

U.S. Pat. No. 3,215,972—E. A. Eriksson

Discloses a spring clip integrally formed with the base, and includes various clip arrangements designed for this function.

U.S. Pat. No. 3,253,249—L. J. Hess et al.—Republic Ind. Corp.

Discloses a baseless bulb with dimples or recesses.

U.S. Pat. No. 4,886,994—A. J. Ragge

Shows a snap-in light bulb which attaches a metal spring clip to the base of a bulb to convert a standard threaded bulb to a plug-in unit for a threaded socket. No attempt is made to change the socket parameters for snap-in use.

SUMMARY

In general terms, the invention disclosed hereby is a light bulb mounting arrangement which includes at least one continuous grooved indentation about the base portion. The bulb is retained in a substantially tubular socket which is in a close fitting o telescopic relation with the base. The retaining mechanism has at least two spring-loaded fingers having nodes thereon with cross-sectional profiles similar to and matable with those of the grooved indentions. Further details are shown on the attached sketches by the inventor and the designer.

OBJECT AND FEATURES OF THE INVENTION

It is an object of the present invention to provide an improved light bulb and socket arrangement.

It is a further object of the present invention to provide a light bulb that is mountable by translation along the longitudinal axis thereof without regard to radial alignment.

It is another object of the present invention to provide a secure mounting of a light bulb in which the envelope thereof will not separate from the base during retraction from the socket.

It is still yet another object of the present invention to provide a balanced and stabilized mounting arrangement for a light bulb.

It is a feature of the present invention that the socket and bulb base will not corrosively adhere the one to the other.

It is another feature of the present invention to have a balanced spring tension exerted on all sides of the base and thereby enhancing vibration resistance of the bulb and extending bulb life.

Other objects and features of the invention will become apparent upon review of the drawings and the detailed description which follow.

BRIEF DESCRIPTION OF THE DRAWINGS

In the following drawings, the same parts in the various views are afforded the same reference designators.

FIG. 7 is a cross-sectional view of the invention taken along line 7—7 of FIG. 5 to show the socket details;

FIG. 8 is a front elevational view of a second embodiment of an electric light bulb and socket system, shown with a portion of the socket partially broken away;

FIG. 9 is a cross-sectional view of the invention taken along line 9—9 of FIG. 8 to show the socket details;

DESCRIPTION OF THE PREFERRED EMBODIMENT

Figure 1:
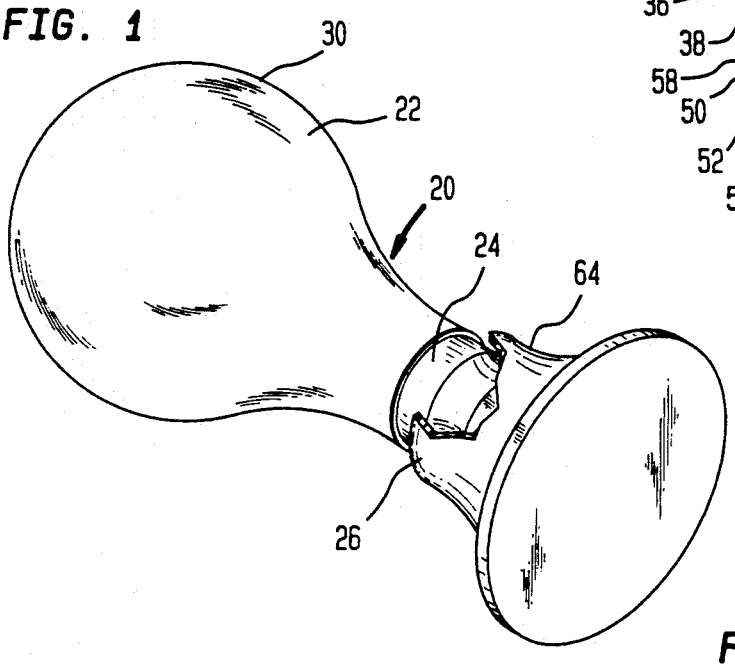
FIG. 1 is a perspective view of an electric light bulb and socket system of the present invention, shown with a portion of the socket partially broken away.
Figure 3:
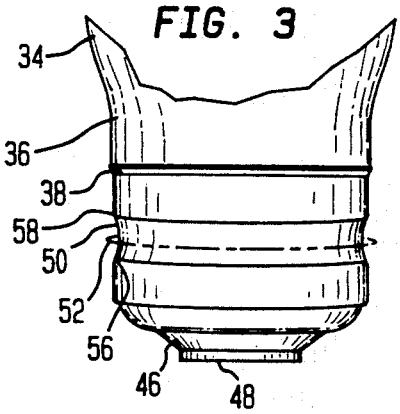
FIG. 3 is a cross-sectional view of the invention to show details of the retaining groove of the bulb.
Figure 2:
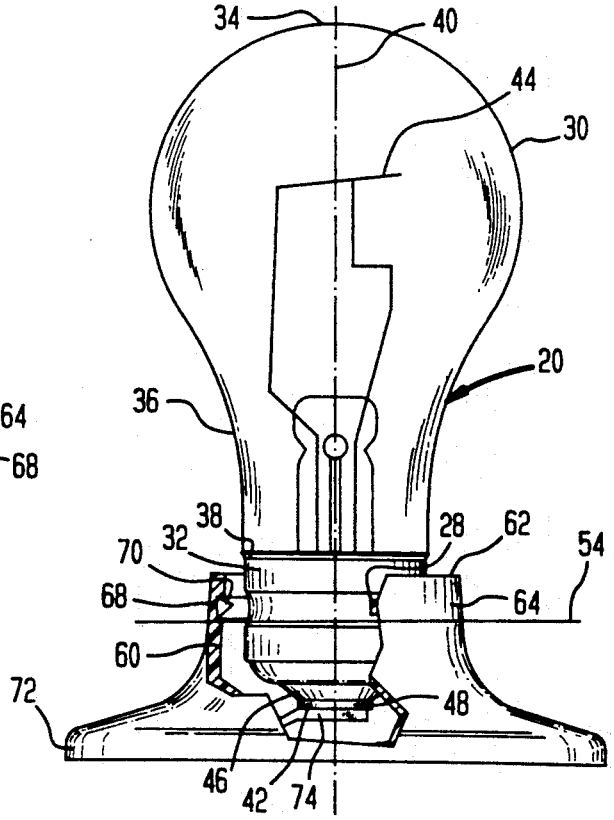
FIG. 2 is a front elevational view of the invention shown in FIG. 1, shown with a portion of the socket partially broken away to illustrate the dimensional relationships with the bulb installed.

Referring to FIGS. 1, 2 and 3 a light bulb and socket system generally referred to by the numeral 20, is shown. The system 20 includes a bulb 22 with a non-threaded base 24 and a socket 26 with a spring retainer 28. The exterior of the bulb 22, as seen in greater detail in FIG. 2 is defined by a globe 30 and a substantially cylindrical wall 32 of base 24. The wall 32 is constructed of a conductive material such as the brass, copper or other metal alloy common to the conventional threaded bulb. The globe 30 is constructed with an upper substantially spherical envelope or dome 34 and a lower tapered neck portion 36 which is dimensioned to mate with the throat 38 of base wall 32. Although the terms "upper" and "lower" are used these terms are merely for ease of description and are descriptive of the drawings; however, such terms do not limit the position of the bulb during operation. Further and also for descriptive purposes, the bulb has a longitudinal axis 40 extending from the top of the dome 34, coincident with and along the longitudinal axis of the cylindrical base wall 32, and to the center of the bottom 42 of the bulb 22. The bulb 22 is structured to include a lamp element 44 extending from the bottom center 42 in to the interior of the globe 30. The bulb 22 has an insulating portion or plate 46 in which an electrically conductive portion or terminal 48 is centrally located. The insulating plate 46 is substantially frustoconical in form and with terminal 48 closes the bottom of the base wall 32 to provide a sealed unit. During operation, base wall 32 and terminal 48 electrically connect element 44 to power supplied. About the base 32 is a retaining groove 50 which is uniquely profiled for the application at hand and developed especially therefor. The centerline 52 of groove 50 lies in a plane 54 normal to the longitudinal axis 40. The distance along the longitudinal axis 40 between the plane 54 and bottom of terminal 48 is selected so that when during operation the bulb 22 is inserted in and retained by socket 26, the terminal 48 reaches a fixed position with respect thereto. The retaining groove 50 has a profile best seen in the cross-sectional view of FIG. 3. Here the portion of the groove 50 closest to the bottom center 42 or terminal 48 has a radius permitting the spring retainer, described hereinbelow, to be guided thereover. This radius defines an entry throat portion 56. Further, the portion of the groove 50 closest to the dome 34 has a radius stopping the movement of spring retainer, described hereinbelow. This radius defines a travel limit portion 58. The inside of the groove 50 is smoothly curved in both the radial and axial aspects thereof.

Figure 4:
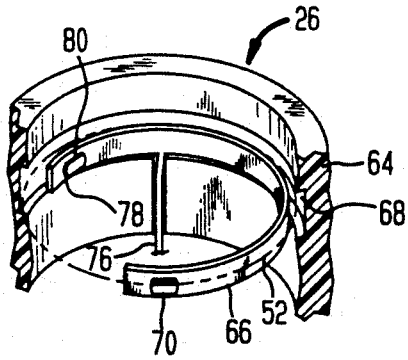
FIG. 4 is a partial perspective view of the invention to show details of the socket and retainer spring.

Turning now to FIG. 4 the socket 26 is next described. The socket 26 is constructed from an insulative plastic composite or ceramic, the unit may be structured from almost any acceptable material that provides the degree of insulation required. The socket includes a receptacle 60 with an opening or cavity 62 to receive the substantially cylindrical base wall 32. The wall 32 and substantially cylindrical wall 64 of socket 26 are close in tolerance so that the bulb may be easily slid into and be readily spring retained thereby without significant side-to-side play. The socket has a retainer spring 66 constructed to be housed in a C-shaped, spring-retaining well 68. The well 68 is designed to extend radially about center line 52 so that only the convex spring portion of the retainer spring 66 extends into cavity 62. The retainer spring 66 has three convex spring portions or fingers 70 for extension into groove 50. The spring fingers 70 are designed to exert even spring tension on the groove 50 and thus are spaced at 120° intervals about the base or radially at 0°, 120° and 240° about axis 40. Further the fingers 70 are designed so that, upon extension into the groove, the spring fingers 70 assume substantially the same profile as groove 50 and also have a sizable contact area with the bulb base. The socket 26 has at least two electrically connective portions at the base thereof. In the best mode of this invention, one forms an electrical pathway from socket base 72 to terminal 48 of bulb 22 through spring electrical contact portion 74. The other forms a electrical pathway from socket base 72 to bulb base 24 through electrical lead 76. The electrical lead 76 may, in turn, be formed by any one of several means including a metallic rib extending within the socket wall 6 (not protruding into the passageway) from the retainer spring 66 to the socket base 72 or even by a printed lead deposited on the interior of the socket 26. However, the lead 76 described herein is structured it is isolated from contact portion 74 in a manner to preclude occurrence of short circuits. The spring lugs 70 are next described in greater detail. Each spring lug 70 has a profile best seen in the cross-sectional view of FIG. 3. Here the portion of the spring lug 70 closest to the spring contact portion 74 has a radius 78 corresponding and opposite that of entry throat portion 56 of retaining groove 50. Futher, the stop portion 80 of the spring lug 70 corresponds with travel limit portion 58 of retaining groove 50. With the interrelationship of retaining groove 50 and spring lug 70 just described certain structural aspects are futher delineated. Spring lug 70 is designed so that force required to remove the bulb from the socket base 72 is greater by far than the force exerted on terminal 48 by spring electrical contact portion 74.

Figure 5:
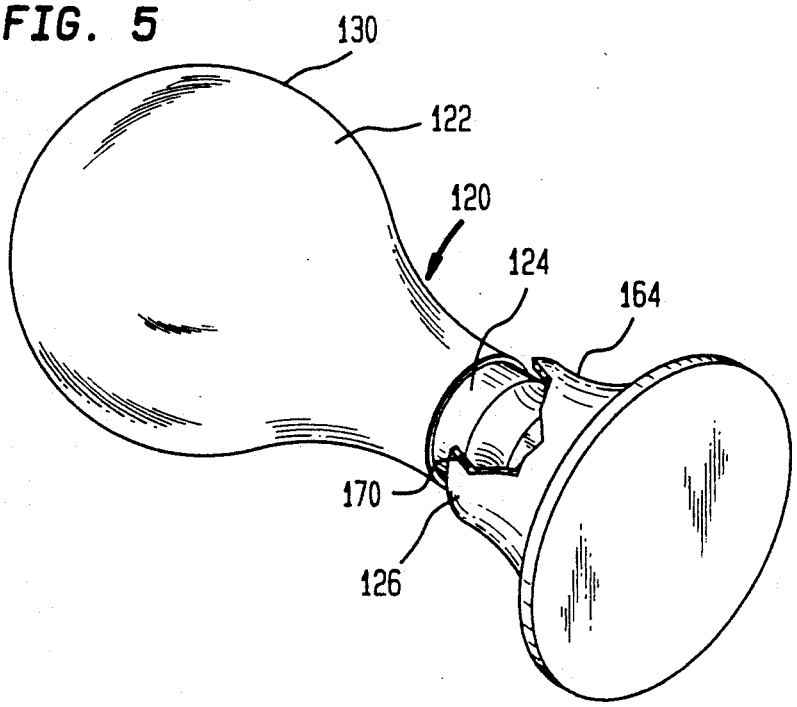
FIG. 5 is a perspective view of a second embodiment of an electric light bulb and socket system of the present invention, shown with a portion of the socket partially broken away.
Figure 6:
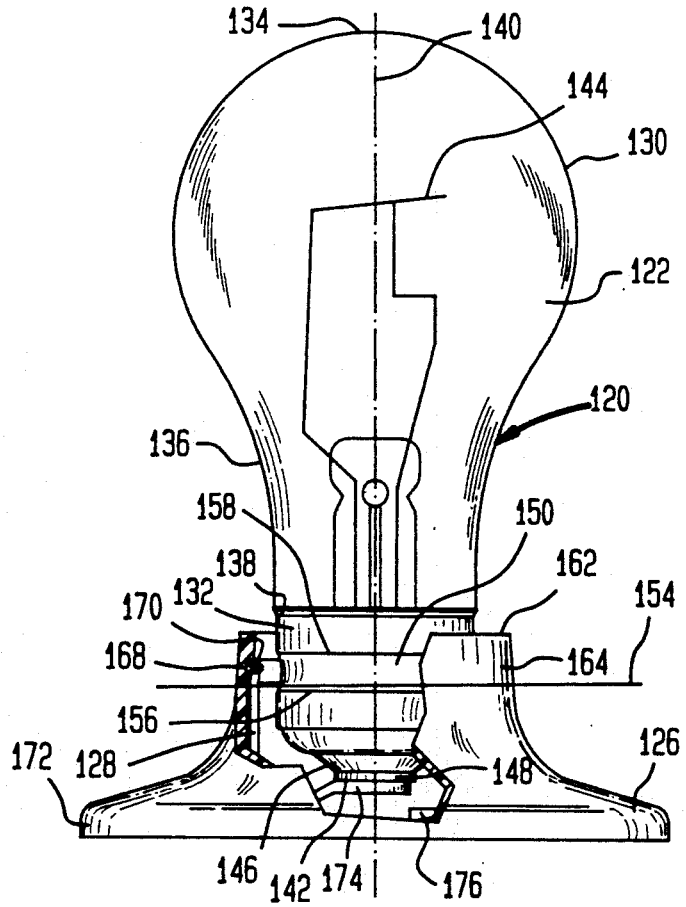
FIG. 6 is a front elevational view of the invention shown in FIG. 5, shown with a portion of the socket partially broken away to illustrate the dimensional relationships with the bulb installed.

Turning now to the second embodiment of the present invention, reference is made to FIGS. 5, 6 and 7 showing a light bulb and socket system generally referred to by the numeral 120. In further embodiments of the invention, for convenience similar parts shown in the additional drawings carry reference designators "100" units higher in the second embodiment and "200" units higher in the third embodiment. For example, the retaining groove 50 of the first embodiment finds an analogous groove 150 in the second embodiment and groove 250 in the third embodiment. The system 120 includes a bulb 122 with a non-threaded base 124 and a socket 126 with a spring retainer 128. The exterior of the bulb 122, as seen in greater detail in FIG. 6 is defined by a globe 130 and a substantially cylindrical wall 132 of base 124. The wall 132 is constructed of a conductive material such as the brass, copper or other metal alloy common to the conventional threaded bulb. The globe 130 is constructed with an upper substantially spherical envelope or dome 134 and a lower tapered neck portion 136 which is dimensioned to mate with the throat 138 of base wall 132. In contrast to the first embodiment, the bulb 122 is larger in scale and is of heavier construction, such as is frequently referred to as a "mogul" type base. Further and also for descriptive purposes, the bulb has a longitudinal axis 140 extending from the top of the dome 134, coincident with and along the longitudinal axis of the cylindrical base wall 132, and to the center of the bottom 142 of the bulb 122. The bulb 122 is structured to include a lamp element 144 extending from the bottom center 142 in to the interior of the globe 130. The bulb 122 has an insulating portion or plate 146 in which an electrically conductive portion or terminal 148 is centrally located. The insulating plate 146 is substantially frustoconical in form and with terminal 148 closes the bottom of the base wall 132 to provide a sealed unit. During operation, base wall 132 and terminal 148 electrically connect element 144 to power supplied. About the base 132 is a retaining groove 150 which is uniquely profiled for the application at hand and developed especially therefor. The centerline 152 of groove 150 lies in a plane 154 normal to the longitudinal axis 140. The distance along the longitudinal axis 140 between the plane 154 and bottom of terminal 148 is selected so that when during operation the bulb 122 is inserted in and retained by socket 126, the terminal 148 reaches a fixed position with respect thereto. The retaining groove 150 has a profile best seen in the cross-sectional view of FIG. 6. Here the portion of the groove 150 closest to the bottom center 142 or terminal 148 has a radius permitting the spring retainer, described hereinbelow, to be guided thereover. This radius defines an entry throat portion 156 of retaining groove 150. Further, the portion of the groove 150 closest to the dome 134 has a radius stopping the movement of spring retainer, described hereinbelow. This radius defines a travel limit portion 158, which, because of the scale of the mogul-type bulf 122, is more clearly delineated as to the mechanical travel limiting function. The inside of the groove 150 is smoothly curved in both the radial and axial aspects thereof.

Turning now to FIG. 7 a socket 126 is next described. While the socket 126 of the second embodiment includes a receptacle 160 with an opening 162 to receive the substantially cylindrical base wall 132. The wall 132 and substantially cylindrical wall 164 of socket 126 are close in tolerance so that the bulb may be easily slid into and be readily spring retained thereby without significant side-to-side play. The socket has a crown-shaped retainer spring 166 constructed to seat at the bottom of the socket cavity and having portions arising therefrom that snap into retainer spring groove 168. For this embodiment, the retainer spring 166 has four spring arms 170 for extension into groove 150. The arms 170 are positioned about the longitudinal axis at 0°, 90°, 180°, and 270°. Further the arms 170 are designed so that, upon extension into the groove, the spring arms 170 assume substantially the same profile as groove 150 and thereby have a sizable contact area with the bulb base. The socket 126 has at least two electrically connective portions at the base thereof. One forms an electrical pathway from socket base 172 to terminal 148 of bulb 122 through spring electrical contact portion 174. The other forms an electrical pathway from socket base 172 to bulb base 124 through electrical lead 176. The electrical lead 176 is formed by a simple terminal connection to the base of crown-shaped retainer spring 166. However, the lead 176 is structured, it is isolated from contact portion 174 in a manner to preclude occurrence of short circuits. The spring arms 170 are next described in greater detail. Each spring arm 170 has a profile best seen in the cross-sectional view of FIG. 6. Here the portion of the spring arm 170 closest to the spring contact portion 174 has a corrugated portion 178 corresponding and opposite that of entry throat portion 156 of retaining groove 150. Further, the stop portion 180 of the spring arm 170 corresponds with travel limit portion 158 of retaining groove 150. With the interrelationship of retaining groove 150 and spring arm 170 just described certain structural aspects are further delineated. Spring arm 170 is designed so that force required to remove the bulb from the socket base 172 is far greater than the force exerted on terminal 148 by spring electrical contact portion 174.

Referring to FIGS. 8 and 9 a light bulb and socket system generally referred to by the numeral 220 is shown. The system 220 includes a bulb 222 with a non-threaded base 224 and a socket 226 with a spring retaining adapter 228. The exterior of the bulb 222 is defined by a globe 230 and a substantially cylindrical wall 232 of base 224. The wall 232 is constructed of a conductive material such as the brass, copper or other metal alloy. The globe 230 is constructed with an upper substantially spherical envelope or dome 234 and a lower tapered neck portion 236 which is dimensioned to mate with the throat 238 of base wall 232. For descriptive purposes, the longitudinal axis 240 is defined as extending from the top of the dome 234, coincident with and along the longitudinal axis of the cylindrical base wall 232, and to the center of the bottom 242 of the bulb 222. The bulb 222 is structured to include a lamp element 244 extending from the bottom center 242 in to the interior of the globe 230. The bulb 222 has an insulating portion or plate 246 in which an electrically conductive portion or terminal 248 is centrally located. The insulating plate 246 is substantially frustoconical in form and, with terminal 248, closes the bottom of the base wall 232 to provide a sealed unit. During operation, base wall 232 and terminal 248 electrically connect element 244 to power supplied. About the base 232 is a retaining groove 250 which is uniquely profiled for the application at hand and developed especially therefor. The centerline 252 of groove 250 lies in a plane 254 normal to the longitudinal axis 240. The distance along the longitudinal axis 240 between the plane 254 and bottom of terminal 248 is selected so that when during operation the bulb 222 is inserted in and retained by socket 226, the terminal 248 reaches a fixed position with respect thereto. The retaining groove 250 has a concave profile best seen in the cross-sectional view. Here, the portion of the groove 250 closest to the bottom center 242 or terminal 248 has a radius permitting the fingers of the spring retainer, described hereinbelow, to be guided thereover. This radius defines an entry throat portion 256. Further, the portion of the groove 250 closest to the dome 234 has a radius stopping the movement of spring retainer, described hereinbelow. This radius defines a travel limit portion 258. The inside of the groove 250 is smoothly curved in both the radial and axial aspects thereof. The socket includes a receptacle 260 with an opening 262 to receive the substantially cylintrical base wall 232. The wall 232 and substantially cylindrical wall 264 of socket 226 are close in tolerance so that the bulb ma be easily slid into and be readily spring retained thereby without significant side-to-side play. The socket has a retainer spring adapter 266 constructed to seat on the floor of the socket 226 with arms extending into retainer spring grooves 268. For this embodiment, to retainer spring 266 has two spring fingers 270 for extension into groove 250. The fingers 270 are designed so that, upon extension into the groove, the spring fingers 270 assume substantially the same profile as groove 250 and thereby have a sizable contact area with the bulb base. The socket 226 has at least two electrically connective portions at the base thereof. One forms an electrical pathway from socket base 272 to terminal 248 of bulb 222 through spring electrical contact portion 274. The other forms a electrical pathway from socket base 272 to bulb base 224 through electrical lead 276. The partially cutaway cup-like portion is structured to be isolated from contact portion 274 in a manner to preclude occurrence of short circuits. Optionally, a series of insulating rib portions 277 may be molded into the socket base 272 to preclude contact between the adapter 228 and the spring electrical contact portion 274. The spring fingers 270 are next described in greater detail. Each spring lug 270 has a profile best seen in the cross-sectional view of FIG. 8. Here the portion of the spring lug 270 closest to the spring contact portion 274 has a radius 278 corresponding and opposite that of entry throat portion 256 of retaining groove 250. Futher, the stop portion 280 of the spring finger 270 corresponds with travel limit portion 258 of retaining groove 250. With the interrelationship of retaining groove 250 and spring lug 270 just described certain structural aspects are futher delineated. Spring finger 270 is designed so that force required to remove the bulb from the socket base 272 is far greater than the force exerted on terminal 248 by spring electrical contact portion 274.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. An electric light bulb and socket system having a bulb with a globe sealed to a metal alloy base and having a socket with a corresponding receptacle for said bulb base, said system comprising, in combination:

said bulb having a substantially cylindrical wall at said base thereof;

groove means extending into and about said bulb base with the centerline thereof lying within a plane normal to the longitudinal axis of said bulb;

a socket base with an open cavity therein and a substantially cylindrical wall dimensioned to slidably engage said bulb base;

retaining spring means for retaining said bulb, said retaining spring means in the wall of said socket base with a plurality of lug portions of said retaining spring means extending into said cavity of said socket base;

spring terminal means for electrical connection to the bottom of said metal alloy base; and said plurality of lug portions of said retaining spring means dimensioned to, upon the bulb insertion into the receptacle, seat within said groove means, said plurality of lug portions being equally spaced about the groove means and exerting balanced spring pressure on the bulb to retain the bulb in the socket;

whereby the insertion of the bulb into the socket is by axial movement without orientation and without rotation thereof.

2. An electric light bulb and socket system and as described in claim 1 wherein said groove further comprises a throat portion with a gradual sloping entry and a shoulder portion with a radius defining a travel limit.

3. An electric light bulb and socket system as described in claim 2 wherein said plurality of lug portions, upon insertion of said bulb in said socket substantially conform to the profile of said groove and thereby providing the spring contact required for said bulb retention.

4. An electric light bulb and socket system as described in claim 3 wherein said retaining spring means is a snap ring having a belt-like shape and snap fitting into a recess in said socket base with only the lug portions thereof extending into said cavity of said socket base.

5. An electric light bulb and socket system a described in claim 4 wherein said lug portions further comprise three lugs radially spaced about said longitudinal axis at 0°, 120° and 240°.

6. An electric light bulb and socket system as described in claim 4 wherein said lug portions further comprises four lugs radially spaced about said longitudinal axis at 0°, 90°, 180° and 270°.

7. An electric light bulb and socket system as described in claim 3 wherein said retainer spring means in turn further comprises:

a spring base having a ring-like shape and dimensioned to seat in said cavity at the end opposite the opening thereinto;

a plurality of finger portions extending from said spring lease engaging said socket base without protruding into said cavity; and, a plurality of lug portions, each said lug portion extending from one of said finger portions into said cavity for engagement with said groove.

8. An electric light bulb and socket system as described in claim 7 wherein said big portions further comprise three lugs radially spaced about said longitudinal axis at 0°, 120° and 240°.

9. An electric light bulb and socket system as described in claim 7 wherein said lug portions further comprises four lugs radially spaced about said longitudinal axis at 0°, 90°, 180° and 270°.

10. An electric light bulb and socket system as described in claim 3 wherein said retainer spring means, in turn, further comprises:

a spring base having a modified cup-like shape and dimensioned to seat in said cavity at the end opposite the opening thereinto without contact with said spring terminal means;

a plurality of finger portions extending from said spring base without protruding into said cavity; and, a plurality of lug portions, each said lug portion extending from one of said finger portions into said cavity for engagement with said groove.

11. An electric light bulb and socket system as described in claim 10 wherein said big portions further comprise three lugs radially spaced about said longitudinal axis at 0°, 120° and 240°.

12. An electric light bulb and socket system as described in claim 10 wherein said lug portions further comprises four lugs radially spaced about said longitudinal axis at 0°, 90°, 180° and 270° .

13. An electric light bulb and socket system having a bulb with a globe sealed to a metal alloy base and having a socket with a corresponding receptacle for said bulb base, said system comprising, in combination:

said bulb having a substantially cylindrical wall at said base thereof;

groove means extending into and about said bulb base with the centerline thereof lying within a plane normal to the longitudinal axis of said bulb, said groove having a throat portion with a gradual sloping entry and a shoulder portion with a radius defining a travel limit;

a socket base having a cavity therein with a substantially cylindrical wall dimensioned to slidably engage said bulb base;

retaining spring means for retaining said bulb, said retaining spring means in the wall of said socket base with a plurality of lug portions of said retaining spring means extending into said cavity of said socket base, said retaining spring means, in turn, further comprising:

a spring base having a ring-like shape and dimensioned to seat in said cavity at the end opposite the opening thereinto;

a plurality of finger portions extending from said spring base engaging said socket base without protruding into said cavity; and, plurality of lug portions, each said lug portion extending from one of said finger portions into said cavity for engagement with said groove;

spring terminal means for electrical connection to the bottom of said metal alloy base; and said plurality of lug portions of said retaining spring means dimensioned, upon the bulb insertion into the receptacle with the spring terminal means slightly compressed, to protrude into said groove means, to seat within said groove means, to exert balanced spring pressure on the bulb to retain the bulb in the socket, and to conform to the profile of said groove, and to thereby provide the spring contact required for said bulb retention;

whereby the insertion of the bulb into the socket is by axial movement without orientation and without rotation thereof.

14. An electric light bulb and socket system as described in claim 13 wherein said lug portions further comprise three lugs radially spaced about said longitudinal axis at 0°, 120° and 240°.

15. An electric light bulb and socket system as described in claim 13 wherein said lug portions further comprises four lugs radially spaced about said longitudinal axis at 0°, 90°, 180° and 270°.

16. An electric light bulb and socket system having a bulb with a globe sealed to a metal alloy base and having a socket with a corresponding receptacle for said bulb base, said system comprising, in combination:

said bulb having a substantially cylindrical wall at said base thereof;

groove means extending into and about said bulb base with the centerline thereof lying within a plane normal to the longitudinal axis of said bulb, said groove having a throat portion with a gradual sloping entry and a shoulder portion with a radius defining a travel limit;

a socket base having a cavity therein with a substantially cylindrical wall dimensioned to slidably engage said bulb base;

retaining spring means for retaining said bulb, said retaining spring means in the wall of said socket base with a plurality of lug portions of said retaining spring means extending into said cavity of said socket base, said retaining spring means, in turn, further comprising:

a spring base having a modified cup-like shape and dimensioned to seat in said cavity at the end opposite the opening thereinto without contact with said spring terminal means;

a plurality of finger portions extending from said spring base without protruding into said cavity; and, a plurality of lug portions, each said lug portion extending from one of said finger portions into said cavity for engagement with said groove;

spring terminal means for electrical connection to the bottom of said metal alloy bas; and said plurality of lug portions of said retaining spring means dimensioned, upon the bulb insertion into the receptacle with the spring terminal means slightly compressed, to protrude into said groove means, to seat within said groove means, to exert balanced spring pressure on the bulb to retain the bulb in the socket, and to conform to the profile of said groove, and to thereby provide the spring contact required for said bulb retention;

whereby the insertion of the bulb into the socket is by axial movement without orientation and without rotation thereof.

17. An electric light bulb and socket system as described in claim 16 wherein said big portions further comprise three lugs radially spaced about said longitudinal axis at 0°, 120° and 240°.

18. An electric light bulb and socket system as described in claim 16 wherein said lug portions further comprises four lugs radially spaced about said longitudinal axis at 0°, 90°, 180° and 270°.

* * * * *